US007219469B2

(12) United States Patent
DiFrancesco

(10) Patent No.: US 7,219,469 B2
(45) Date of Patent: May 22, 2007

(54) WINDOW OR DOOR LOCK SYSTEM

(76) Inventor: Carlo DiFrancesco, 30 Royal Group Crescent, Woodbridge, Ontario (CA) L4H 1X9

( * ) Notice: Subject to any disclaimer, the term of this patent is extended or adjusted under 35 U.S.C. 154(b) by 322 days.

(21) Appl. No.: 11/019,211

(22) Filed: Dec. 23, 2004

(65) Prior Publication Data

US 2006/0137254 A1 Jun. 29, 2006

(51) Int. Cl.
*E05C 9/00* (2006.01)
*E05C 17/00* (2006.01)

(52) U.S. Cl. ..... 49/395; 49/394; 49/503; 292/143; 292/DIG. 20

(58) Field of Classification Search ..... 49/395, 49/394, 503; 292/143, DIG. 20, 137, 138, 292/DIG. 47, 302
See application file for complete search history.

(56) References Cited

U.S. PATENT DOCUMENTS 2,523,559 A * 9/1950 Couture ..... 292/DIG. 20
3,949,525 A * 4/1976 Bates et al. ..... 49/395
4,227,725 A * 10/1980 Lindquist et al. .... 292/DIG. 47
4,610,472 A * 9/1986 Billingsley ..... 292/DIG. 47
4,803,808 A * 2/1989 Greisner ..... 49/394
5,111,615 A * 5/1992 Kuhnt et al. ..... 49/394
5,730,477 A * 3/1998 Nagy ..... 292/DIG. 20
6,637,784 B1 * 10/2003 Hauber et al. ..... 292/302
6,651,389 B2 * 11/2003 Minter et al. ..... 49/394
6,837,004 B2 * 1/2005 Annes ..... 49/394
7,004,515 B2 * 2/2006 Timothy ..... 292/137
7,090,263 B2 * 8/2006 Quigley et al. ..... 292/302
7,100,327 B2 * 9/2006 Rangabasyam et al. ..... 49/395

* cited by examiner

*Primary Examiner*—Hugh B. Thompson, II

(57) ABSTRACT

A window or door includes a frame mounted to a building. The frame has first and second side jambs, a frame closure in the form of a window or door has a first side edge pivotally mounted to the first side jamb of the frame for opening and closing the closure member relative to the frame. The closure member has a second side edge which locates adjacent the second side jamb of the frame when the closure member is closed. The second side edge of the closure member includes a first lock part. The second side jamb of the frame includes a channel extending lengthwise of the frame. The channel has a channel mouth along its length, which faces interiorly of the frame. Undercut channel regions are provided to each side of the channel mouth. A slide bar is slideably fitted in the channel and a second lock part is secured to the slide bar. The second lock part protrudes through the channel mouth and when the closure member is closed with the frame the slide bar slides the second lock part into and out of locking engagement with the first lock part on the second side edge of closure member.

8 Claims, 5 Drawing Sheets

23
17
13
23
21
19
15
21
17
14
18
33
35
31
35
37
35

FIG. 3.
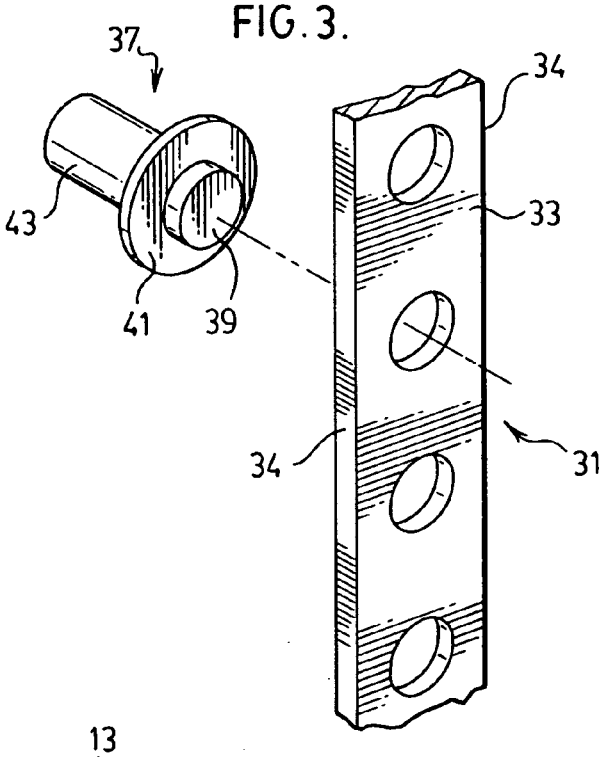
FIG. 4.
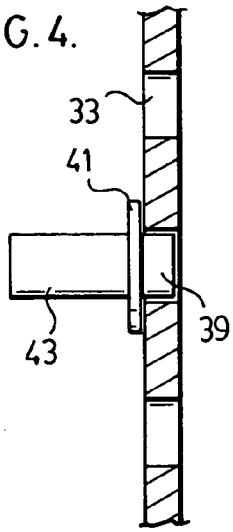
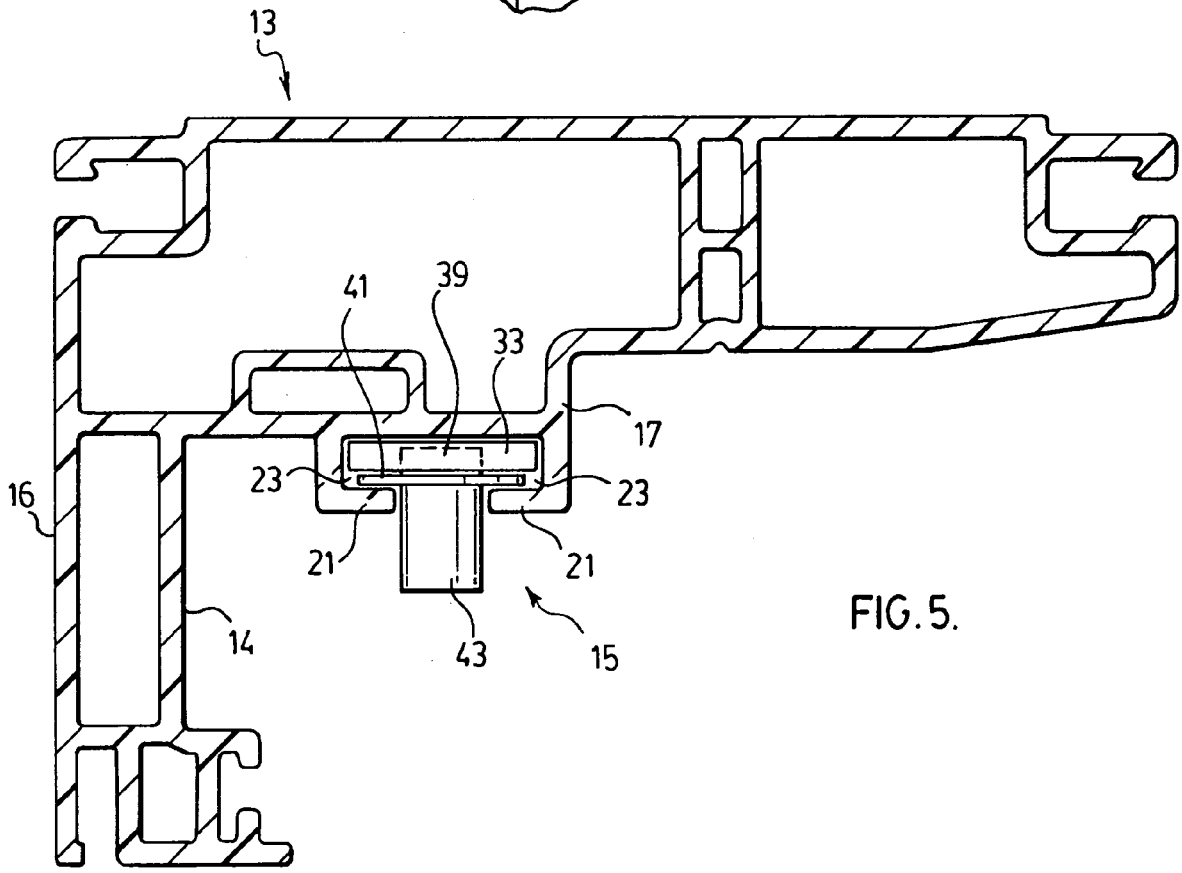
FIG. 5.

WINDOW OR DOOR LOCK SYSTEM

FIELD OF THE INVENTION

The present invention relates to a window or door assembly which includes a lock system for locking the window or door of the assembly.

BACKGROUND OF THE INVENTION

Over the last few years significant developments have been made with respect to the window and door industry. Many of the new windows and doors include the most up to date hardware for opening and closing the window or door and for locking the window or door. The locking hardware is particularly important due to a number of increasing incidents of break-ins and burglaries. Often time's more than one lock on a window or door is desired to ensure the integrity of the window or door. When more than one lock is used on a window or door it becomes difficult to determine where the hardware for operating the lock is to be appropriately located on the window or door assembly. Furthermore, when numerous locks are used traditional thinking results in a window or door having a separate lock control for each lock. This not only adds to the cost of the assembly but in addition creates a very cluttered appearance. In addition, in order to operate the locking system one must remember to perform separate locking actions at each of the lock regions.

SUMMARY OF THE PRESENT INVENTION

A window or door lock system of the present invention comprises a frame mounted to a building and including first and second side jambs. A frame closure member i.e., a window or a door has a first side edge which is pivotally mounted to the first side jamb of the frame for opening and closing the closure member relative to the frame. The closure member has a second side edge which locates adjacent the second side jamb of the frame when the closure member is closed.

The second side edge of the closure member includes a first lock part. The second side jamb of the frame includes a channel extending lengthwise of the frame. The channel has a channel mouth along its length facing interiorly of the frame. The channel also has undercut channel regions to each side of the channel mouth.

A slide bar is slideably fitted in the channel and a second lock part is secured to the slide bar. The second lock part protrudes through the mouth of the channel.

When the closure member is closed with the frame the slide bar slides the second lock part into and out of locking engagement with the first lock part on the second side edge of the closure member to either lock the closure member with or to release the closure member from the frame.

Using a construction as described immediately above, more than one lock part may be provided on the closure member and more than lock part may be provided on the side bar. Regardless of the number of lock parts on each of these components, a single sliding motion of the slide bar allows the lock parts on the slide bar to slide into and out of locking engagement with corresponding lock parts on the closure member. As such, nothing more than a single control for operating all of the locks is required with the window or door lock system of the present invention.

BRIEF DESCRIPTION OF THE DRAWINGS

The above as well as other advantages and features of the present invention will be described in greater detail according to the preferred embodiments of the present invention in which;

FIG. 3 is an exploded perspective view of a portion of the slide bar from the window assembly of FIG. 1;

FIG. 4 is a side view of the components of the slide bar as shown in FIG. 3 when assembled;

FIG. 5 is a sectional view looking down through the side jamb of FIG. 2 with the side bar in position within the side jamb;

DETAILED DESCRIPTION ACCORDING TO THE PREFERRED EMBODIMENTS OF THE PRESENT INVENTION IN WHICH

Figure 1:
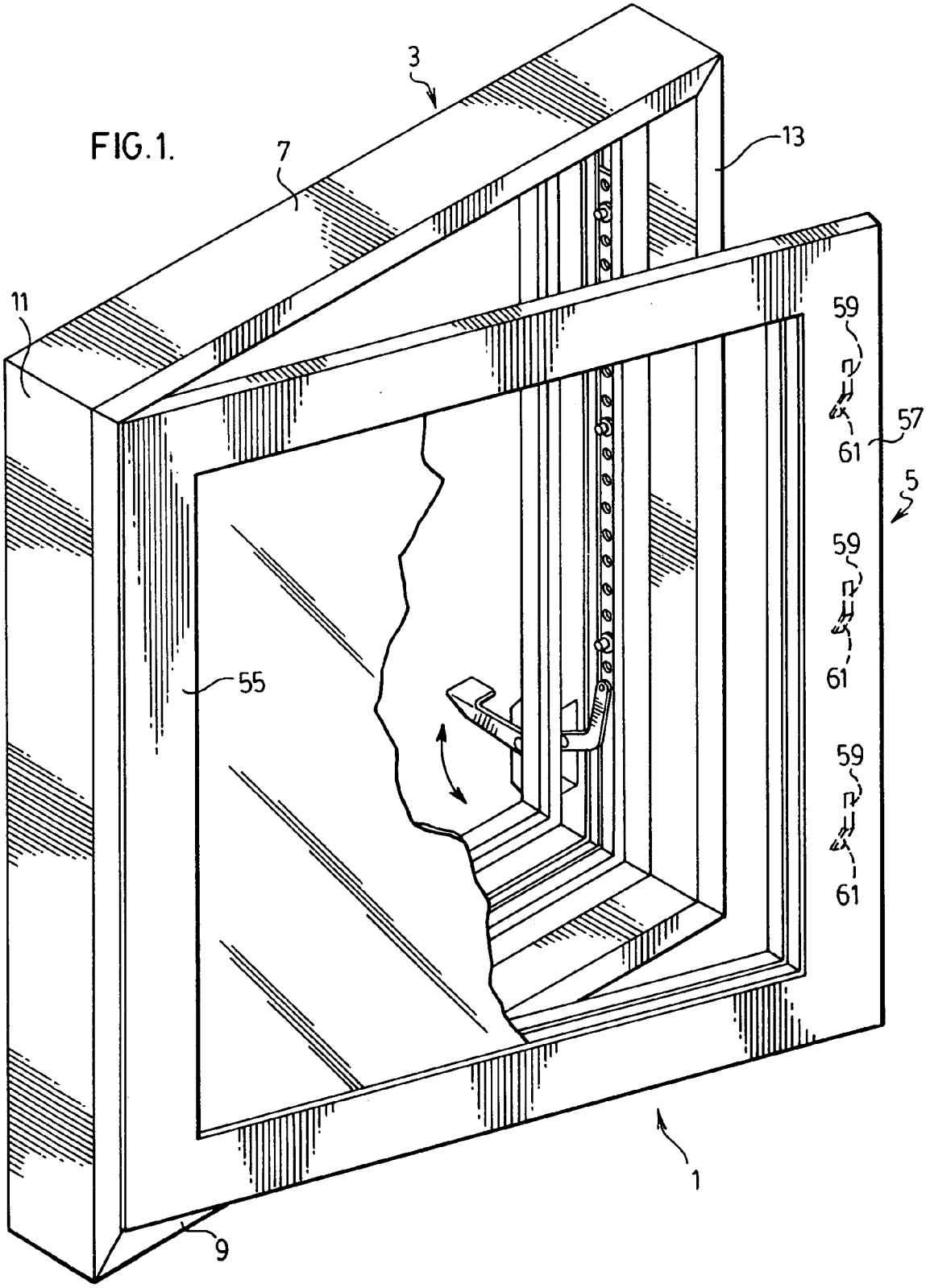
FIG. 1 is perspective view of a window assembly including a lock system according to a preferred embodiment of the present invention.

FIG. 1 shows a window assembly generally indicated at 1. This window assembly comprises a frame generally indicated at 3 and a sash generally indicated at 5. Frame 3 mounts in a building wall opening with the sash in turn being mounted to the frame.

The key to the present invention relates to the inclusion of a lock system within window assembly 3. This lock system is to be described later in detail. However, before going into the specifics of the lock system it is to be understood that this same lock system is equally as well used in a door assembly comprising a door mounting frame and a door mounted to that frame.

Returning to FIG. 1 of the drawings, frame 3 comprises a header 7 a sill 9 and first and second side jambs 11 and 11 respectively.

All of the above describes frame pieces are preferably made from a vinyl extrusion. Each of the pieces is preferably cut from a common length of extrusion and then cut to desired sizes to make the header jambs and sill of the frame.

Figure 2:
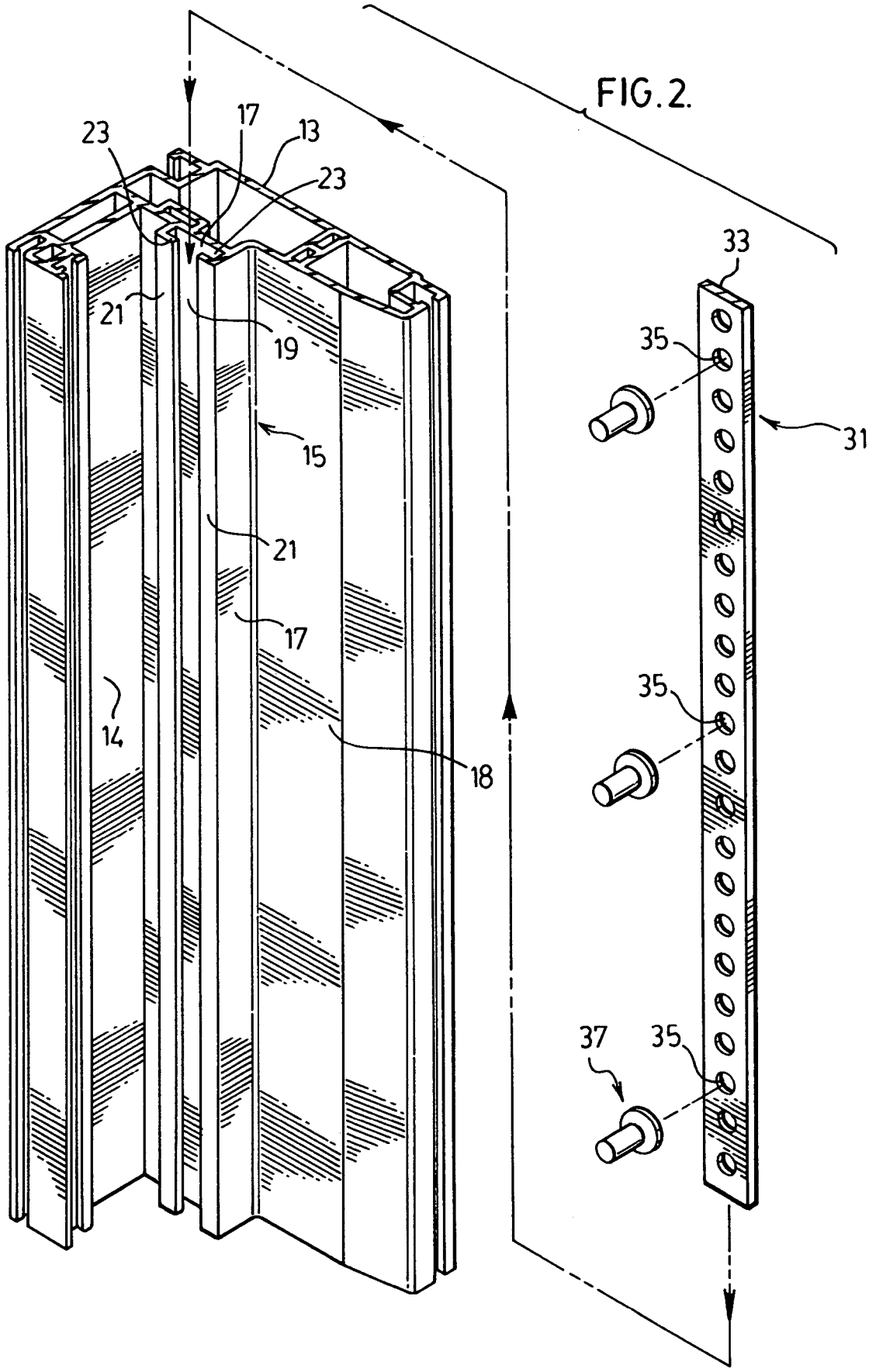
FIG. 2 is an exploded perspective view of one of the side jambs of the frame of the window assembly of FIG. 1.

Turning to FIG. 2 of the drawings, a key component of the vinyl extrusion of side jamb 13 is a channel forming piece generally indicated at 15. This channel forming piece includes an internal hollow 17 with a channel mouth 19 opening interiorly of the window frame. Channel mouth 19 extends the full height of channel piece 15.

Provided to opposite sides of channel piece 15 are a pair of mouth bordering legs 21. These legs define undercut regions 23 along the length of the opening 17 within channel piece 15.

Window sash 5 includes a first sash jamb 55 and a second sash jamb 57. Sash jamb 55 is pivotally mounted to frame jamb 11 for opening and closing the sash relative to the frame.

Sash jamb 57 when the window is closed fits inside of frame jamb 13. As best seen in FIG. 5 of the drawings channel forming piece 15 has a front face 17. Face 17 provides a stop for the sash jamb 5 when the window is closed.

Figure 7:
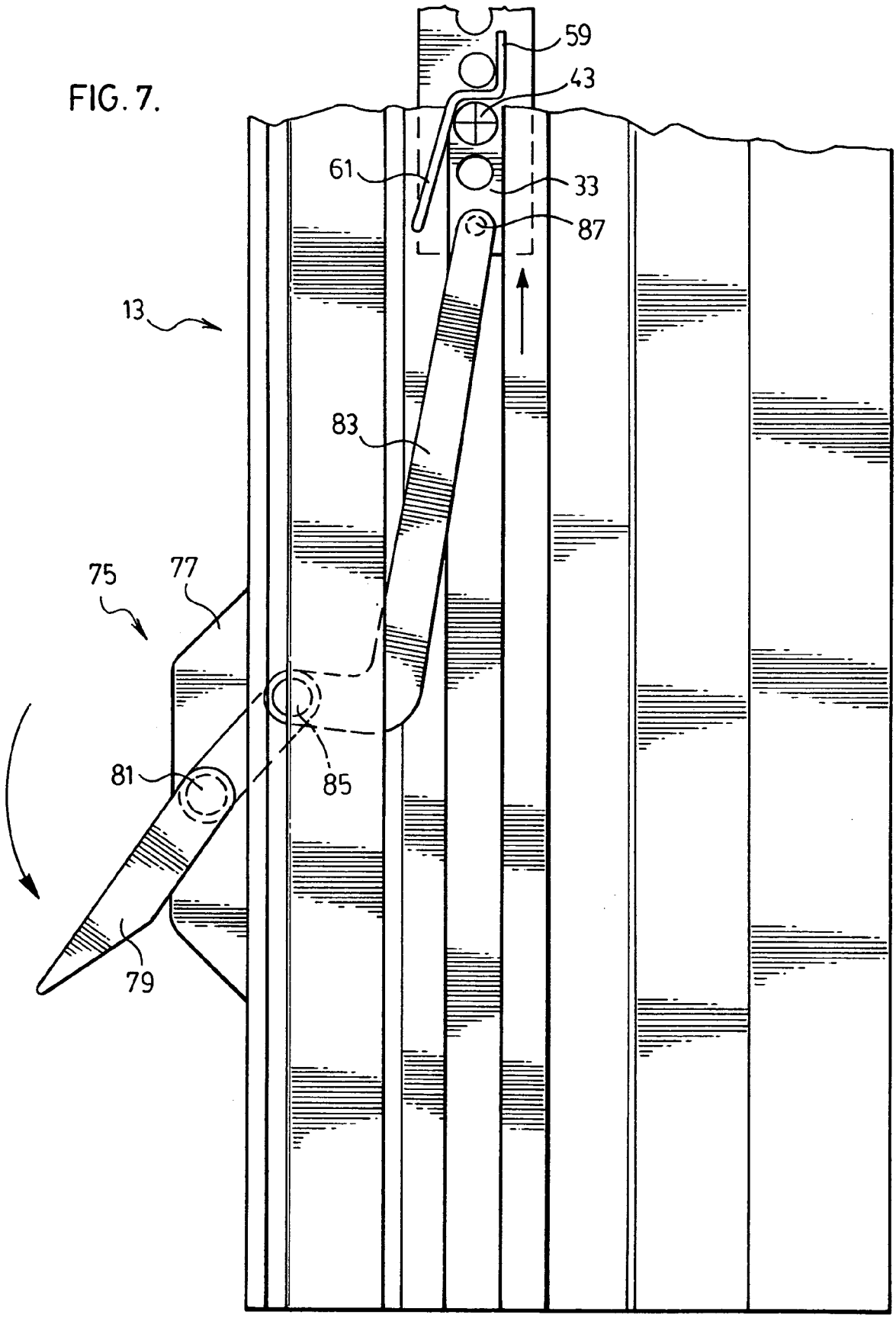
FIG. 7 is a view similar to FIG. 6 but showing the window closed and locked with the frame.

Before the window is assembled to its FIG. 1 configuration e.g., before the FIG. 7 is fitted to the frame a slide bar generally indicated at 31 is located within channel 17. The actual bar portion of slide bar 31 is wider than the channel mouth 19 such that the opposite edges 34 of bar 33 locate within the undercut regions 23 of the channel opening. This prevents the bar from pulling outwardly through the mouth of the channel.

Fitted to bar portion 33 are a plurality of studs generally indicated at 37. These studs include a cylindrical body portion 43 having a head 39 which fits into any one of the circular openings 35 provided along the length of bar portion 33. A larger collar 47 fits over the cylindrical body portion 43 of each of the studs. Collar 41 abuts with the flat side face of bar portion 33.

The heads of the studs 37 may either be simply held by a friction fit within the opening bar portion 33 or they may be additionally secured in place by some type of bonding agent between the stud and the bar portion.

The studs at their spaced apart locations along bar portion 33 are centered on the bar portion. The main body portion 43 of each of the studs projects through the channel mouth 19 interiorly of the window frame. The collar portion 41 in each of the studs as well seen in FIG. 5 of the drawings is trapped against lateral movement out of the channel opening by means of the return legs 21 defining the undercut regions 23 in the channel opening.

As it will be appreciated from the description above control bar 31 with the studs mounted thereon is slideable vertically of the frame jamb but cannot be pulled out of the frame jamb once the frame has been fully assembled.

It is be further noted from the description above that because the channel mouth is open over the complete length of the channel the control bar with its studs is easily located within the frame jamb by simply sliding it down into the frame jamb before the header has been put into position. Once the header has been assembled with the rest of the frame, it is not only the bar portion 33 but in addition the studs on the bar portion due to the provision of their collars 41 which are trapped in the channel cannot be pulled out of the channel.

Returning to FIG. 1 it will be seen that sash jamb 57 at the free or moveable edge of the sash is provided on its interior surface with a plurality of lock parts 59. Each one of these lock parts as better seen in FIG. 6 of the drawings includes a downwardly outwardly free ended leg 61. Leg 61 when the sash is closed within the frame locates to the inside of channel piece 15 sitting over the mouth of the channel.

Provided on frame jamb 13 is a lock control handle generally indicated at 75. Frame jamb 13 includes an inner return part generally indicated at 14 having a flat face region 16. Face region 16 locates to the interior of the building. A handle mount 77 secures to the face 16 of frame return 14. Pivotally mounted at 81 to mount 77 is a handle piece 79. Handle piece 79 is pivotally secured at 85 to a lock connecting piece 83. The lock connecting piece where pivotally secured to handle member 79 fits through a precut slot (not shown) in the frame return 14. This allows the handle with its lock connecting piece to attach by connector 87 to the bar portion 33 of the slide bar. In the preferred embodiment connector 87 comprises a cylindrical attachment that press fits into one of the circular openings in bar 33.

Figure 6:
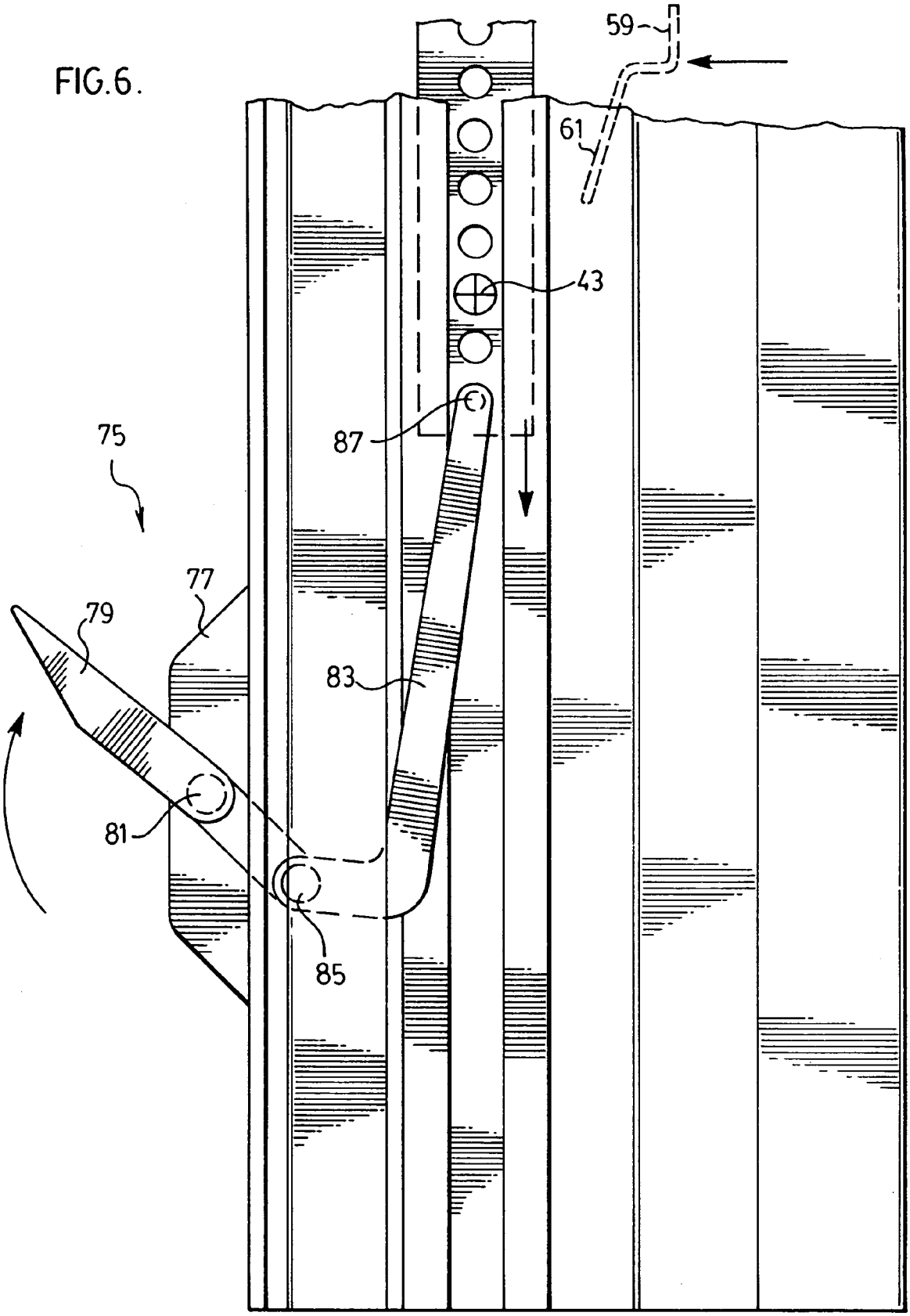
FIG. 6 is an interior view of the side jamb of the window assembly of FIG. 1 showing the locking part on the window in a position to close with the locking part on the window frame.

FIG. 6 of the drawings shows the handle member 79 of the control handle pushed upwardly. As a result of its pivotal connection to mount 77 and the pivotal connection with bar connecting member 83 the bar is pulled downwardly in the FIG. 6 position. The sash is then closed with the window frame such that the arm 61 of lock part 59 on sash jamb 57 locates above body portion 43 of stud 37 secured to the slide bar. FIG. 6 shows the sash moving to this position and the lower most lock part on the sash. As will be readily understood the same movement occurs at the two lock parts of the sash above the one shown in FIG. 6 of the drawings.

Once the lock parts 59 on the sash is located over the channel mouth of the frame jamb handle member 79 of control handle 75 is pushed downwardly to the FIG. 7 position of the drawings. This pushes up on connector piece 83 which forces the slide bar to slide upwardly within the frame channel. Each of the three studs mounted to the slide bar then slides up beneath the free leg 61 of each of the lock parts 59 on the sash. The sash is now fully locked with the frame.

As will be further understood from the description above more studs may be provided on the slide bar and more lock parts may be provided on the sash in appropriately located positions for further enhancing the locking action of the frame on the sash. In the alternative, as few as a single stud and lock part may be used to lock the sash closed with the frame.

In the embodiment as described when using two or more different lock points between the sash and the frame only a single control handle is needed to operate all of those different lock points. Furthermore, if additional lock points are needed as may be the case for a door assembly where the height of the door is substantially greater than the height of a window, the only thing that needs to be added is additional studs and additional door edge lock parts. The slide bar with the spaced holes along the length thereof is already setup to receive these additional studs. To further ease the assembly the frame for receiving the slide bar includes its own slide bar receiving pocket in the way of the elongated channel extruded in the construction of the frame.

Although various preferred embodiments of the present invention have been described in detail, it will be appreciated by those skilled in the art that variations may be made without departing from the spirit of the invention or the scope of the appended claims.

The invention claimed is:

1. A window or door lock system, said system comprising a frame mounted to a building, said frame including first and second side jambs, a frame closure member having a first side edge pivotally mounted to said first side jamb for opening and closing said closure member relative to said frame, said closure member having a second side edge which locates adjacent said second side jambs of said frame when said closure member is closed, said second side edge including a first lock part, said second side jamb of said frame including a channel extending lengthwise thereof, said channel having a channel mouth along the length of said channel and facing into said frame and undercut channel regions to each side of said channel mouth, a slide bar slideably fitted in said channel and a second lock part secured to said slide bar, said second lock part protruding through said mouth of said channel and when said closure member is closed with the frame said slide bar sliding said second lock part into and out of locking engagement with said first lock part on said second side edge of said closure member.

2. A window or door lock system as claimed in claim 1 including a slide bar control pivotally mounted on said second side jambs of said frame and having a bar connecting part fitted through said mouth of said channel with said slide bar.

3. A window or door lock system as claimed in claim 2 wherein said channel has a first side surface which forms a closure stop for said second side edge of said closure member when said closure member is closed, said first lock part extending over said channel member when said second side edge of said closure member is stopped against said first side surface of said channel in a position where said first lock part is to receive said second lock part which slides with said slide bar into the locking engagement with said second lock part.

4. A window or door system as claimed in claim 3 wherein said first side surface of said channel faces an exterior part of said frame, said channel including a second side surface facing an interior side of said frame, said system including a mount for said slide bar control, said slide bar control, said mount being located on the interior side of said frame.

5. A window or door lock system as claimed in claim 1 wherein said second lock part has a head mounted to said slide bar and trapped by said undercut regions in said channel, said second lock part further including a stem which is of reduced diameter relative to said head for fitting through said mouth post of said undercut regions of said channel.

6. A window or door lock system as claimed in claim 5 wherein said slide bar including spaced openings lengthwise thereof, said stem of said second lock part extending part said head and locating within one of said openings in said bar.

7. A window or door lock system as claimed in claim 5 wherein said second lock part is secured to said slide bar prior to fitting said slide bar into said channel.

8. A window or door lock system as claimed in claim 1 wherein said frame has an extruded vinyl construction, said channel forming an integral part of said construction.

* * * * *